US011751647B2

(12) United States Patent
Forsey et al.

(10) Patent No.: US 11,751,647 B2
(45) Date of Patent: Sep. 12, 2023

(54) JEWELLERY PIECE COMPRISING A MECHANISM FOR ANIMATING AN OBJECT

(71) Applicant: GREUBEL FORSEY S.A., La Chaux-de-Fonds (CH)

(72) Inventors: Stephen Forsey, Les Brenets (CH); Anaïs Hamel, La Chaux-de-Fonds (CH)

(73) Assignee: GREUBEL FORSEY S.A., La Chaux-de-Fonds (CH)

( * ) Notice: Subject to any disclaimer, the term of this patent is extended or adjusted under 35 U.S.C. 154(b) by 0 days.

(21) Appl. No.: 17/632,300

(22) PCT Filed: Aug. 3, 2020

(86) PCT No.: PCT/EP2020/071806
§ 371 (c)(1),
(2) Date: Feb. 2, 2022

(87) PCT Pub. No.: WO2021/023710
PCT Pub. Date: Feb. 11, 2021

(65) Prior Publication Data

US 2022/0273079 A1 Sep. 1, 2022

(30) Foreign Application Priority Data

Aug. 7, 2019 (CH) ..... 00995/19
Aug. 7, 2019 (EP) ..... 19190521

(51) Int. Cl.
*A44C 17/02* (2006.01)
*G04B 47/04* (2006.01)

(52) U.S. Cl.
CPC ..... *A44C 17/0258* (2013.01); *G04B 47/042* (2013.01)

(58) Field of Classification Search
CPC ... A44C 17/0258; A44C 17/0275; A44C 5/00; A44C 7/00; A44C 9/00; A44C 9/0053;
(Continued)

(56) References Cited

U.S. PATENT DOCUMENTS 1,025,447 A * 5/1912 Blume ..... A44C 17/0258 63/31
3,305,946 A * 2/1967 Du Gardin ..... G09B 27/08 74/553

(Continued)

FOREIGN PATENT DOCUMENTS

| | | |
|---|---|---|
| CH | 706245 | 10/2013 |
| FR | 2988866 | 10/2013 |
| WO | 200605073 | 5/2006 |

*Primary Examiner* — Jack W Lavinder
(74) *Attorney, Agent, or Firm* — DUANE MORRIS LLP; Gregory M. Lefkowitz

(57) ABSTRACT

Portable jewellery piece comprising a mechanism for animating an object, said mechanism comprising: —a motive source arranged to drive a transmission; —a regulating system arranged to regulate the speed of rotation of said transmission; —a support system bearing an object that is intended to be animated according to a rotation about a first axis of rotation under the effect of said motive source via a power take-off forming part of said transmission. According to the invention, said support system comprises a first frame that is mounted so as to be able to pivot on a frame element about said first axis of rotation, and an inner frame that is mounted so as to be able to pivot in said first frame about a second pivot axis that is substantially orthogonal with respect to said first pivot axis, said object being moreover arranged so as to be driven by an eccentric driving element that is secured in rotation with a driving wheel arranged to be driven by said power take-off.

12 Claims, 5 Drawing Sheets

(58) Field of Classification Search
CPC .... A44C 9/0084; A44C 25/001; G04B 47/042
See application file for complete search history.

(56) References Cited

U.S. PATENT DOCUMENTS

| | | | | |
|---|---|---|---|---|
| 9,445,652 | B1 * | 9/2016 | Yousef | A44C 17/0258 |
| 2014/0126338 | A1 | 5/2014 | Forsey et al. | |

* cited by examiner

JEWELLERY PIECE COMPRISING A MECHANISM FOR ANIMATING AN OBJECT

CROSS-REFERENCE TO RELATED APPLICATIONS

This application is a § 371 national stage entry of International Application No. PCT/EP2020/071806, filed Aug. 3, 2020, which claims priority to European Patent Application No. 19190521.5, filed Aug. 7, 2019, and Swiss Patent Application No. 00995/19, filed Aug. 7, 2019, the entire contents of which are incorporated herein by reference.

TECHNICAL FIELD

The present invention relates to the field of jewelry. It more particularly concerns a piece of jewelry comprising a mechanism for animating an object such as jewel, a precious or semi-precious stone, a sculpture or any other miniature object integrated therein.

PRIOR ART

The document FR2988866 describes a mechanism for animating a precious or semi-precious stone in which a drive spring is arranged to animate the stone in a rotational movement about a single rotational axis by means of a flexible belt. The stone is mounted on a shaft by four claws or jaws, which hold it in place. However, the movement of the stone is monotonous and allows only one of its faces to be seen, which always presents the same angle to the wearer and consequently limits its visibility. Moreover, the scintillation of the stone is therefore relatively limited and the observer is obliged to observe it at an acute angle in order to view more than its crown.

The object of the invention is consequently to propose a piece of jewelry comprising a mechanism for animating an object, in which the abovementioned defects are at least partially overcome.

DISCLOSURE OF THE INVENTION

More precisely, the invention concerns a portable piece of jewelry comprising a mechanism for animating an object, as defined by claim 1. This mechanism comprises:

- a motive source, such as a drive spring or an electric motor, arranged to drive a transmission, such as, for example, geartrain made up of a plurality of toothed members, one or more belts, chains, transmission shafts or comprising other similar means;
- a regulating system, such as an escapement-balance-hairspring system, tuning fork, quartz or similar system, arranged to regulate the speed of rotation of said toothed members;
- a support system bearing an object, such as a precious or semi-precious stone, a jewel, a miniature sculpture or the like, intended to be animated in rotation about at least a first rotational axis, said object being arranged to be driven directly or indirectly by a power take-off from said transmission. In the case where the transmission is composed of geartrain, this power take-off is one of said toothed members, which therefore transmits the force coming from the motive source to the object.

According to the invention, said support system comprises a first frame pivotably mounted on a frame element about said first rotational axis, as well as an interior frame pivotably mounted in said first frame about a second pivot axis that is substantially orthogonal to said first pivot axis. The two frames can be any shape. Moreover, said object is arranged to be driven in rotation about said pivot axes by an eccentric drive element, such as a crank, a lever or the like, that is constrained to rotate with a drive wheel, this latter being arranged to be driven by said power take-off from the transmission.

By these means the object is animated in a composite movement defined by to-and-fro rotations about each of the two rotation axes, which confers on it two degrees of freedom in rotation. The movement generated therefore represents a rotary tilting that enhances the visibility of the object as well as scintillations in the case where the latter is a jewel or a precious or semi-precious stone.

Advantageously, the object is borne by a shaft pivotably mounted in said interior frame about a third axis, said shaft being constrained to rotate with a gear meshing with a fixed or rotary set of teeth that is coaxial with said drive wheel. Thereby, the object is animated in a composite movement defined by the three pivot axes, and pivots in a continuous movement not only in accordance with the aforementioned rotary tilt, but also about the third axis.

Advantageously, the mechanism further comprises a clutch of any type kinematically situated between said power take-off from the transmission and said drive wheel, in order to render the kinematic connection between these two elements disengageable and therefore selective. This enables the animated object to be disengaged from said transmission and therefore enables it to be moved in accordance with movements of the piece in which the mechanism is integrated. This clutch may be arranged to be operated manually (for example by means of a pushbutton or other operating member) or automatically, by any mechanism.

Advantageously, at least a part of the kinematic connection between said transmission and said animated object is flexible, which enables a certain "floating" of the object generated by the movements of said piece. In particular, the object may be connected to the interior frame by means of an elastomeric or similar element and/or the kinematic connection between the drive wheel and the transmission may include an elastic belt.

Advantageously, said regulating system comprises a balance-hairspring oscillator arranged to be maintained in oscillation by an escapement of any kind. These elements may for example be part of a (single, double or multiple, inclined or non-inclined) tourbillon system, (inclined or non-inclined) carousel system or the like. Moreover, a plurality of regulating systems may be combined with one another, thanks to mechanisms known to the person skilled in the art (differentials, etc.).

Advantageously, at least a portion of said animated object projects from the set of said frames, thus maximizing its visibility. In other words, at least a part of said animated object is located at a greater distance from the drive wheel than the entirety of said frames.

BRIEF DESCRIPTION OF THE DRAWINGS

Other details of the invention will become more clearly apparent upon reading the following description, made in reference to the appended drawings, in which.

EMBODIMENT OF THE INVENTION

Figure 1:
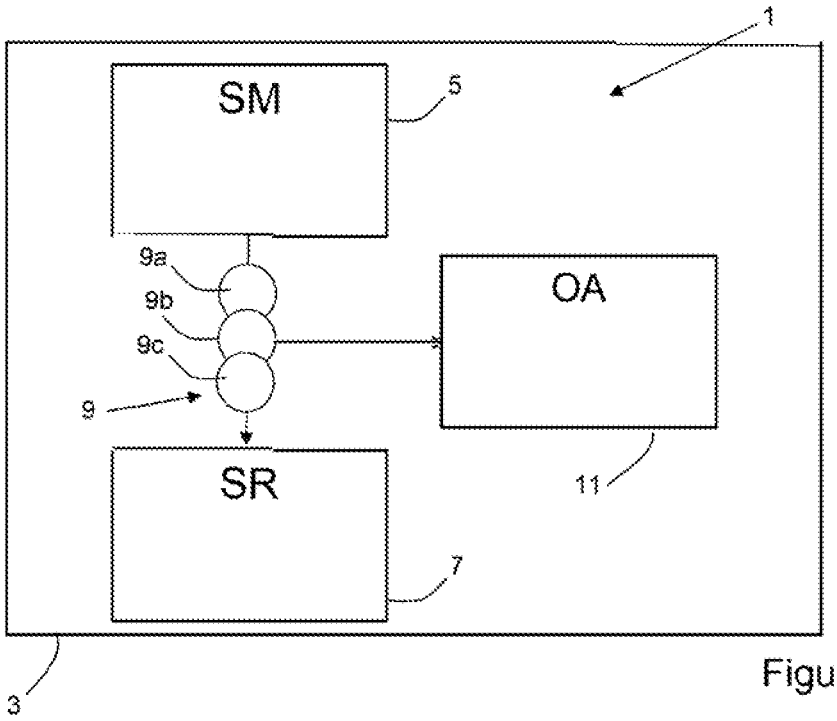
FIG. 1 is a schematic diagram of a piece of jewelry according to the invention, comprising a first variant of an animation mechanism.
Figure 2:
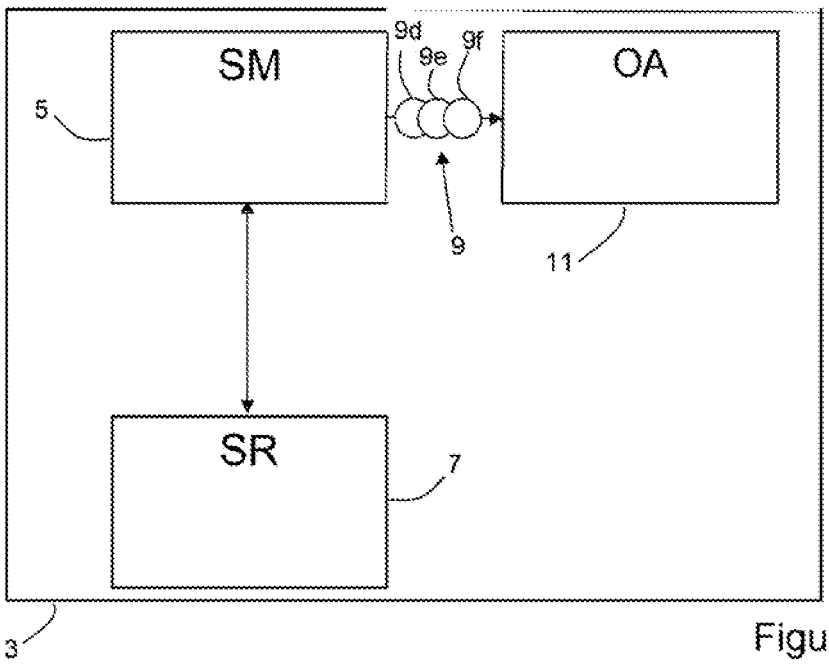
FIG. 2 is a schematic diagram of a piece of jewelry according to the invention, comprising a second variant of an animation mechanism.

FIGS. 1 and 2 schematically illustrate the overall structures of a mechanism 1 for animating an object integrated into a piece of jewelry 3. This latter may be for example a piece of jewelry intended to be worn as a bracelet, necklace, brooch or to be placed on a surface such as a table. In these figures, kinematic and/or functional connections are represented by arrows.

FIG. 1 illustrates a mechanical first variant of such a mechanism 1. In this regard, the mechanism 1 comprises a mechanical motive source 5 such as a drive spring kinematically connected to a regulating system 7 by means of a transmission 9, illustrated here as geartrain 9 composed of a plurality of toothed members, of which three have been indicated by the reference signs 9*a*, 9*b* and 9*c*. The number of toothed members forming part of the geartrain 9 may of course be chosen in accordance with the needs of the constructor. Moreover, other transmission systems known to the person skilled in the art could be used instead of geartrain, such as for example belts, chains, transmission shafts, or any type of transmission, which are within the reach of the person skilled in the art and therefore do not need to be illustrated here. The regulating system 7 may be of any known mechanical type such as for example a centrifugal governor, a paddle wheel turning in air or in a liquid, a tuning fork regulator, an escapement-balance-hairspring regulator, a mono-, bi- or triaxial tourbillon, a carousel or any other similar system (or combination of systems).

One of the toothed members 9*b* serves as a power take-off from the transmission 9 that is arranged to drive an animated object 11, as will become clear hereinafter. In the case where the transmission is composed of a belt, a chain or the like, the power take-off may be constituted by an element that is driven by the latter at a location other than where the kinematic connection with the regulating system 7 is located. The animated object 11 is therefore branched off of the transmission 9.

In the variant of FIG. 2, the motive source 5 may equally be a drive spring, in which case the regulating system 7 is, as mentioned above, connected to the motive source 5 by an ad hoc kinematic connection, or it may alternatively be an electric motor. In the latter case the motive source may for example be a stepper motor the rotation speed of which is controlled by a regulating system 7 such as a quartz system or any other equivalent system. The motive source 5 is kinematically connected to the animated object 11 by means of the transmission 9, also illustrated here as geartrain again comprised of a plurality of toothed members 9*d*, 9*e*, 9*f*, one of which is arranged to drive the animated object 11. In the embodiment represented, the final toothed member 9*f* drives the animated object 11, but it is possible for an intermediate toothed member to do this, which would in particular be the case if the transmission 9 were also to drive watch hands or the like. In the case where the transmission 9 comprises one or more belts or chains, it is kinematically connected to the animated object 11 in an ad hoc manner.

Figure 3:
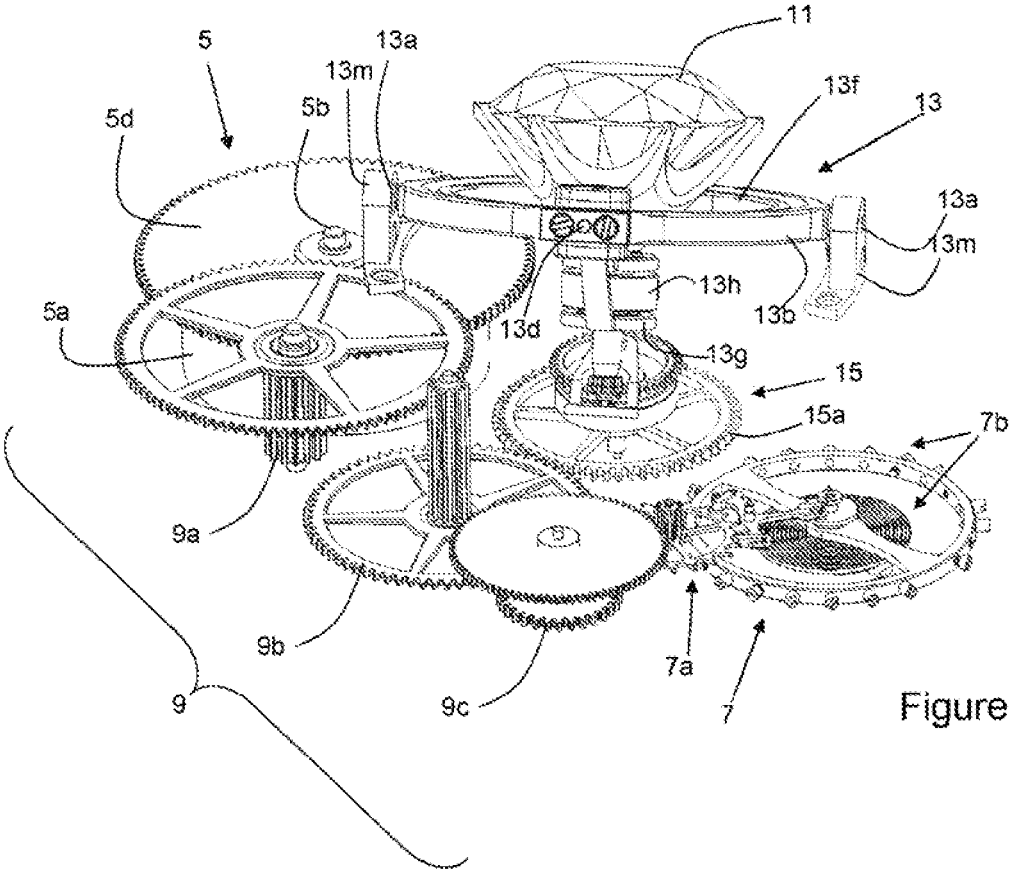
FIG. 3 is an isometric view of a construction of a mechanism that corresponds to the schematic diagram of FIG. 1.
Figure 4:
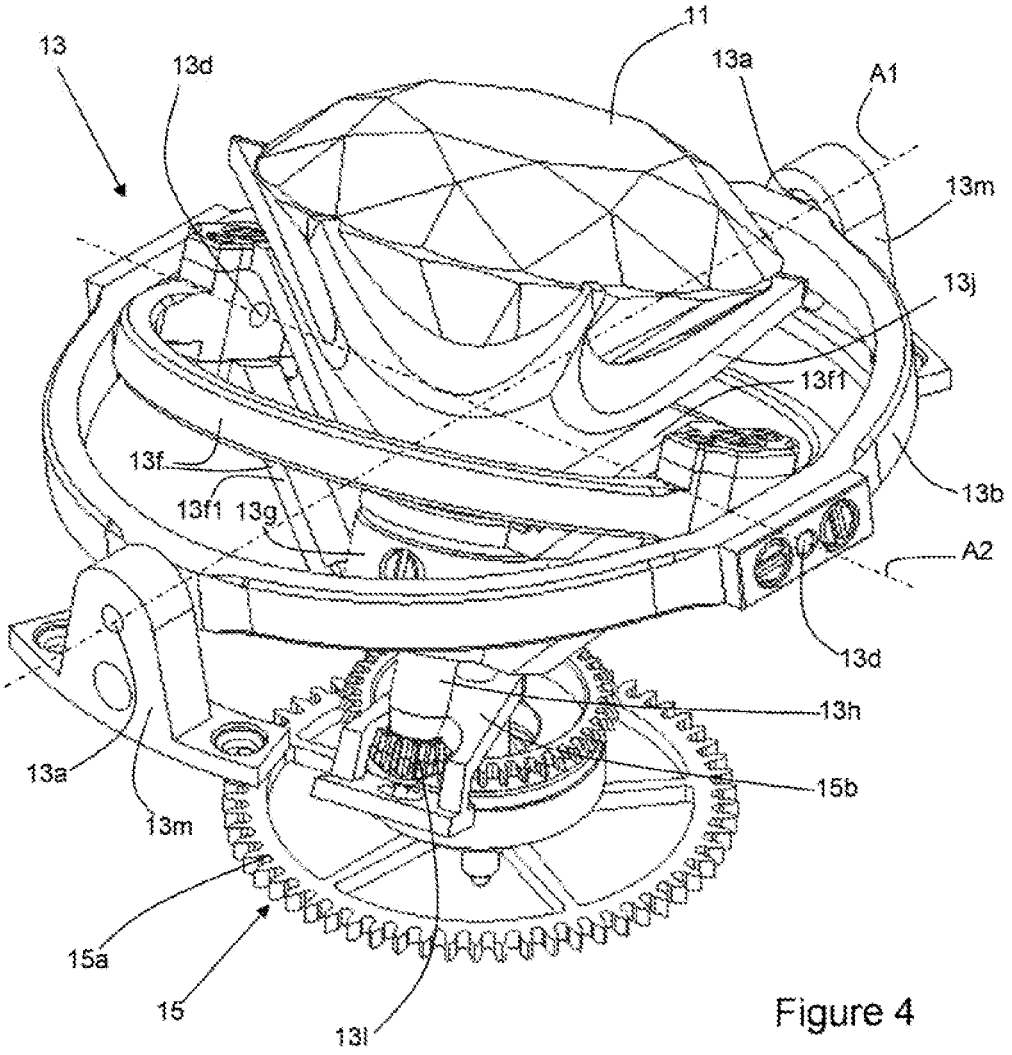
FIG. 4 is an isometric view of the ensemble comprising the animated object, the support system, the drive wheel and the fixed set of teeth.
Figure 5:
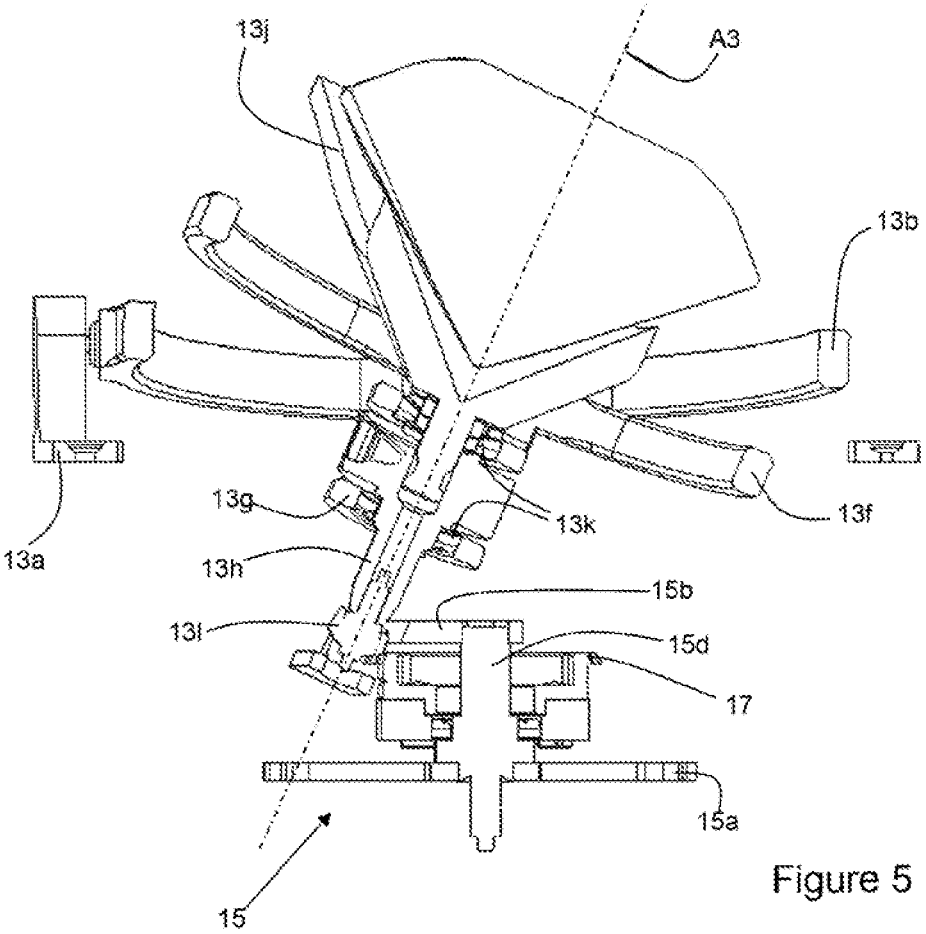
FIG. 5 is an isometric cutaway view of the ensemble illustrated in FIG. 4.

FIGS. 3 to 5 illustrate a concrete embodiment corresponding to the schematic of FIG. 1. Frame elements such as bridges, plates, bearings, etc. have not been represented in order not to overload the drawings.

In this embodiment the motive source 5 is a drive spring (not visible) accommodated in a barrel 5*a* in a known manner. One of the extremities of the drive spring is fixed to a shaft 5*b* that is constrained to rotate with a toothed wheel 5*d* serving as a power take-off that drives the transmission 9, which in this instance is composed of geartrain 9 comprising three toothed members 9*a*, 9*b*, 9*c* meshing with one another two-by-two in known manner. Each of these toothed members 9*a*, 9*b*, 9*c* is composed of two toothed wheels and/or pinions constrained to rotate with one another and pivoting between bearings (not represented) rigidly connected to frame elements (also not represented).

The other extremity of the spring cooperates with the drum of the barrel 5*a*, which may be driven in rotation by a manual winding system and/or automatically in order to wind the spring. Alternatively, the drum of the barrel 5*a* may be constrained to rotate with a set of teeth that drives the geartrain 9, the drive spring being rewound via its shaft 5*b* in this case.

The power take-off of the motive source 5, that is to say the toothed wheel 5*d* in the illustrated construction, is kinematically connected to the regulating system 7 by means of the transmission 9.

The final toothed member 9*c* of the geartrain 9 drives a regulating system 7 of escapement-balance-hairspring type in which an escapement of so-called "Swiss anchor" type maintains the oscillations of a balance-hairspring oscillator in known manner, and which therefore does not need to be described in detail. As mentioned above, other types of regulating system 7 are equally possible, as well as other forms of escapement (English anchor, lever, Omega-Daniels, etc.).

The toothed member 9*b* which is situated in the middle of the geartrain 9 serves as a power take-off for the animated object 11, here illustrated as a precious or semi-precious stone, other variants being possible as explained above. The animated object 11 is supported by a support system 13 that connects it to a frame element (not represented) via a pair of pivots 13*a* borne by supports 13*m* fixed to this latter.

These pivots 13*a* define a first pivot axis A1 about which is pivoted a first frame 13*b* constituted by an annular ring of generally-circular shape. Other shapes (oval, square, rectangular, etc.) are equally possible. This frame bears a pair of intermediate pivots 13*d* that define a second rotational axis A2 substantially orthogonal with respect to said first axis A1. An interior frame 13*f* is pivotably mounted about this second axis A2 and is rigidly connected to a base 13*g* that bears the animated object 11 directly or indirectly. The interior frame 13*f* is composed of a portion having a substantially circular shape as well as two arms 13*f*1 that connect the pivots 13*d* to the base 13*g*. It goes without saying that other shapes are equally possible and it is not even obligatory for the frame 13*f* to include the annular portion. In fact, the base 13*g* may merely be connected to the pivots by the arms 13*f*1 or by some other ad hoc arrangement.

One or both of the frames 13*b*, 13*f* may have any kind of decoration, for example enameling, precious or semi-precious stones or any other required decoration. Moreover, at least one of the shafts of the pivots 13*d*, 13*a* may extend beyond the surface of the element that it passes through, that is to say the exterior surface of the first frame 13*b* for the pivots 13*d* or the exterior surface of the support 13*m* for the pivots 13*a*, and may bear a decoration such as, for example, a precious or semi-precious stone. The movement of this stone will therefore generate scintillations that will accentuate the perception of the pivoting of the frame with which the stone is constrained to rotate.

It is equally to be noted that neither of the frames 13*b*, 13*f* is in superposition with respect to the animated object 11, which extends out from these latter 13*b*, 13*f* and therefore projects, thereby maximizing its visibility. In other words, at least a part of said object 11 is at a greater distance from the drive wheel 15 than the entirety of the frames 13*b*, 13*f*.

In the illustrated embodiment, the animated object 11 is supported by a shaft 13*h* that passes through the base 13*g* and is rigidly connected to a support 13*j* into which the animated object 11 fixed by is crimping. Alternatively, the object 11 may be fixed therein by gluing, screwing, soldering, force-fitting or the like, depending on the nature of the object 11 and of the support 13*j*, and it is noted that the animated object 11 may be coaxial with the shaft 13*h* or off-center with respect to the latter. Moreover, the connection between the animated object 11 and the interior frame 13*f* may include a flexible element, for example in elastomer, to enable a slight "floating" of the object under the effect of the movement of the piece.

The shaft 13*h* is mounted in bearings 13*k* provided in the base 13*g* so that said shaft 13*h* is able to pivot with respect to this latter.

From the foregoing description it is clear that the support system defines a gimbal support which confers on the animated object 11 two degrees of freedom in rotation and substantially no degree of freedom in translation. The pivoting of the shaft 13*h* in the base 13*g* confers a third degree of freedom in rotation on the animated object 11 about a third axis A3 that corresponds to the geometric axis of the shaft 13*h*. However, this third degree of freedom is not obligatory, as explained hereinafter.

The animated object 11 is driven about the third axis A3 by the cooperation between a gear 13*l* constituted by a set of teeth comprised by the shaft 13*h*, and a conical set of teeth 17 that is coaxial with the drive wheel 15 and is fixed in the illustrated construction. Other forms of sets of teeth are equally possible, for example an internal set of conical teeth borne by a crown wheel or other ad hoc geartrain.

In order to animate the object 11, the mechanism further comprises a drive wheel 15 that comprises a toothed wheel 15*a* meshing with the toothed member 9*b* serving as a power take-off. Of course, the interposition of supplementary toothed wheels and/or other kinematic connections such as belts is equally possible. The rotational axis of the drive wheel 15 is arranged substantially to cross the intersection of the axes A1 and A2 but in some configurations some offset is equally allowed, which can render the movement of the object 11 non-symmetrical.

The drive wheel 15 also comprises an eccentric drive element 15*b* that is constrained to rotate with said toothed wheel 15*a* and is connected thereto by a shaft 15*d*. The eccentric drive element 15*b* as illustrated takes the form of a bent lever or crank fixed to the shaft 15*d*, the free end of the eccentric element 15*b* cooperating with the end of the rod 13*h* in order to drive it along a substantially circular path. This being the case, when the drive wheel 15 turns the object 11 effects a composite movement having two degrees of freedom in rotation, the amplitude of which is defined by the geometry of the support system 13 and the radius of the eccentric drive element 15*b*. This is a to-and-fro movement about each of the axes A1 and A2, which creates an inclined orbital movement.

At the same time, the set of teeth 13*l* of the shaft 13*h* rolls on the fixed set of teeth 17, which causes the animated object 11 to pivot about the third axis A3.

By these means, the animated object 11 pivots about the three axes A1, A2, A3 and its movements render it more visible to the observer than in the case of the prior art. Consequently, the observer no longer needs to observe it at acute angles in order to see more than its front face.

It goes without saying that other constructions of the drive eccentric 15*b* are possible and that the gear ratios may be adapted to the needs of the constructor in order to animate the object 11 with a desired rotation speed about the three rotation axes.

As mentioned hereinabove, rotation of the object 11 about the third axis A3 is not obligatory. In this case, the fixed set of teeth 17 and the gear 13*l* of the shaft 13*h* may be omitted, the movement of the animated object being therefore defined exclusively by to-and-fro rotations about the two axes A1 and A2.

In view of the foregoing disclosure, it is clear that the support system 13 is distinct from the regulating system 7, the latter merely serving to determine the speed of rotation of the transmission 9 and the speed of movement of the animated object 11, which is driven by a branch connection from the transmission 9. In other words, the animated object 11 is not part of the regulating system 7, is not mounted on an element of the latter, does not bear any element of the regulating system 7, and may be considered kinematically in parallel with the latter.

The same principle may be applied to an embodiment as illustrated in FIG. 2, whether it be driven mechanically or electrically. In such a case, the sub-assembly of FIGS. 4 and 5 is driven by the geartrain 9 as noted hereinabove in the context of FIG. 2.

In order to enable illumination of the object 11 from below (that is to say from the direction of the drive wheel 15), the support system 13 may be located inside or superposed on a polished well (not illustrated) that may for example take the form of a goblet, a parabolic, elliptical, hemispherical or similar mirror, that is arranged to direct ambient light onto the lower face of the object. A further alternative is for a light source (for example a tritium element, one or more LEDs or the like) to be placed under the object and the frames 13*b*, 13*f*. By these means, if the object 11 is a stone, its scintillations may be enhanced.

Of course, other constructions are possible. For example, the drive wheel 15 may be part of the transmission 9, being the toothed member 9*b* (or other member) for example. The kinematic links can have a relatively large play and/or include elastic elements such as elastic belts or the like, in order to enable the animated object 11 to "float" to some degree under the effect of movements of the piece 3. The set of teeth may equally be animated in rotation by an ad hoc kinematic connection, which enables a freer choice in determining the rotation speed of the object about the axis A3. Further alternatively, the animated object 11 may be kinematically connected to the transmission 9 via differential gearing.

Figure 6:
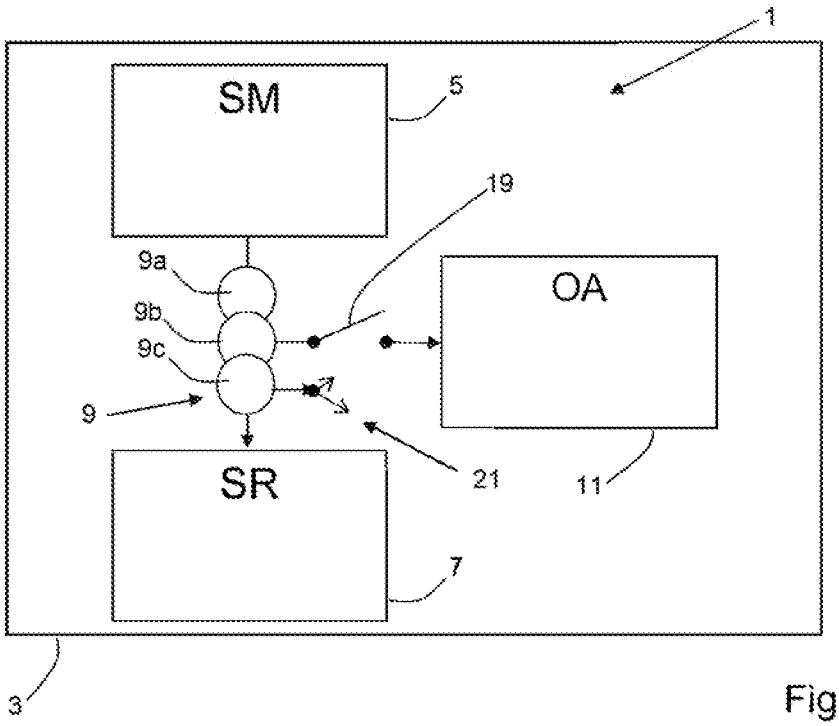
FIG. 6 is a schematic diagram similar to that of FIG. 1 further illustrating a few possible and optional modifications.

FIG. 6 illustrates schematically a further variant of a construction that differs from that of FIG. 1 in that a clutch 19 is provided between the transmission 9 and the animated object 11. This clutch 19 can take any known form, such as for example a vertical, horizontal, inclining-pinion or differential clutch for example (all of these clutches being in particular known in chronograph mechanisms and therefore need not be described in detail here), may be operated manually by means of a pushbutton, a trigger piece or the like, or alternatively automatically by any mechanism. A further alternative is for the clutch 19 to be of the intermittent tooth type.

When the clutch 19 is engaged, the mechanism functions as described hereinabove. However, when the clutch is disengaged, the animated object 11 is free to move under its own weight and/or because of movements of the piece 3, the drive wheel 15 being free to turn.

The same principle may equally be applied, mutatis mutandis, to the embodiment of FIG. 2, in which case the clutch 19 may alternatively be located in said geartrain 9.

Finally, FIG. 6 illustrates a further optional, independent adaptation of the clutch 19, in particular a set of watch hands 21 driven from a toothed member 9*c* of the transmission 9 in order to indicate the time or any other time-related indication. In a case of this kind the piece of jewelry 3 may be a wristwatch, a pocket watch, a clock or the like.

Although the invention has been described above in relation to specific embodiments, other supplemental variants may equally be envisaged without departing from the scope of the invention as defined by the claims.

The invention claimed is:

1. A portable piece of jewelry comprising a mechanism for animating an object, said mechanism comprising:

a motive source arranged to drive a transmission;

a regulating system arranged to regulate the rotation speed of said transmission;

a support system bearing an object intended to be animated in rotation about a first rotational axis by said motive source via a power take-off forming part of said transmission, wherein said support system comprises a first frame pivotably mounted on a frame element about said first rotational axis as well as an interior frame pivotably mounted in said first frame about a second pivot axis that is substantially orthogonal with respect to said first pivot axis;

and in that said object is arranged to be driven by an eccentric drive element constrained to rotate with a drive wheel arranged to be driven by said power take-off.

2. The piece of jewelry as claimed in claim 1, in which said object is borne by a shaft pivotably mounted in said interior frame about a third rotational axis, said shaft being constrained to rotate with a gear meshing with a set of teeth that is coaxial with said drive wheel, said set of teeth being fixed or arranged to be animated with a rotation.

3. The piece of jewelry as claimed in claim 1, in which said eccentric drive element is a crank or a lever.

4. The piece of jewelry as claimed in claim 1, in which said transmission comprises a geartrain composed of a plurality of toothed members.

5. The piece of jewelry as claimed in claim 4, in which said power take-off is constituted by one of said toothed members.

6. The piece of jewelry as claimed claim 1, further comprising a clutch kinematically situated between said power take-off and said drive wheel.

7. The piece of jewelry as claimed in claim 6, in which said clutch is arranged to be controlled manually or automatically.

8. The piece of jewelry as claimed in claim 1, in which at least a part of the kinematic connection between said transmission and said object is flexible.

9. The piece of jewelry as claimed in claim 1, in which said motive source is a drive spring.

10. The piece of jewelry as claimed in claim 1, in which said regulating system comprises a balance-hairspring oscillator arranged to be driven by an escapement.

11. The piece of jewelry as claimed in claim 1, in which said motive source is an electric motor, said regulating system preferably being a quartz system.

12. The piece of jewelry as claimed in claim 11, in which at least a portion of said object projects outside said first frame and said interior frame.

* * * * *